United States Patent [19]

Pike

[11] Patent Number: 4,591,693

[45] Date of Patent: May 27, 1986

[54] COMPANION WARMER

[76] Inventor: Carl A. Pike, 2341 Duane Rd., Palm Springs, Calif. 92262

[21] Appl. No.: 701,295

[22] Filed: Feb. 13, 1985

[51] Int. Cl.[4] ..... A47C 21/04

[52] U.S. Cl. ..... 219/217; 5/513; 5/284; 5/421; 219/528; 219/201

[58] Field of Search ..... 219/211, 212, 217, 528, 219/548, 200, 201; 128/399, 403, 376; 5/284, 421, 508, 513

[56] References Cited

U.S. PATENT DOCUMENTS

| | | | |
|---|---|---|---|
| 825,763 | 7/1906 | Schaefer | 5/421 |
| 1,094,679 | 4/1914 | Roberti | 5/513 |
| 1,532,497 | 4/1925 | Jones | 5/513 |
| 1,558,278 | 10/1925 | Phillips | 219/200 |
| 2,162,021 | 6/1939 | Kidwell | 219/217 |
| 2,640,205 | 6/1953 | Simpson | 5/421 |
| 3,014,117 | 12/1961 | Madding | 128/403 |
| 3,103,219 | 9/1963 | Chadner | 128/399 |
| 3,480,760 | 11/1969 | Young | 5/421 |
| 4,081,150 | 3/1978 | Tyson | 128/403 |
| 4,335,725 | 6/1982 | Geldmacher | 128/399 |

FOREIGN PATENT DOCUMENTS

| | | | |
|---|---|---|---|
| 204144 | 2/1950 | Austria | 219/217 |
| 894125 | 2/1972 | Canada | 5/513 |
| 932472 | 7/1963 | United Kingdom | 219/217 |

*Primary Examiner*—C. L. Albritton
*Assistant Examiner*—Teresa J. Walberg
*Attorney, Agent, or Firm*—Hubbard, Stetina and Brunda

[57] ABSTRACT

A combination elongate soft resilient foamed polymer body, so constructed and configured as to lie along the side of the body of a human user, and a heater enclosing the polymer body, the heater being formed of fabric and including electrically insulated resistance heating lines extending substantially the length of and along the sides of the foamed polymer body, for warming a human user during sleep is disclosed.

9 Claims, 4 Drawing Figures

Fig. 1
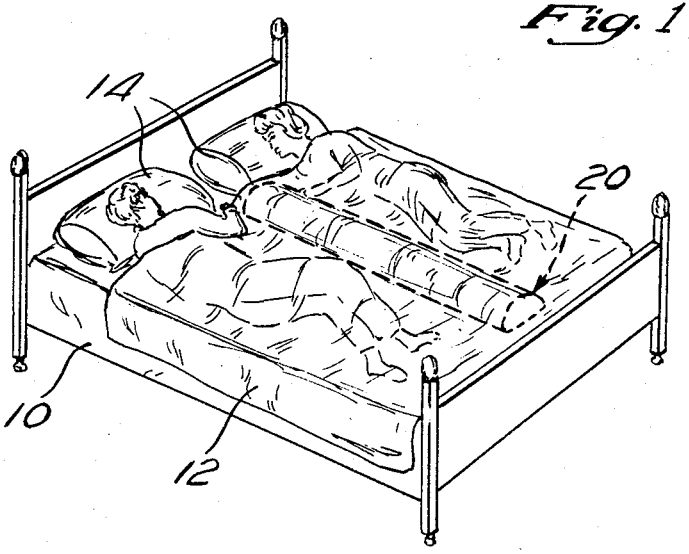
Fig. 2
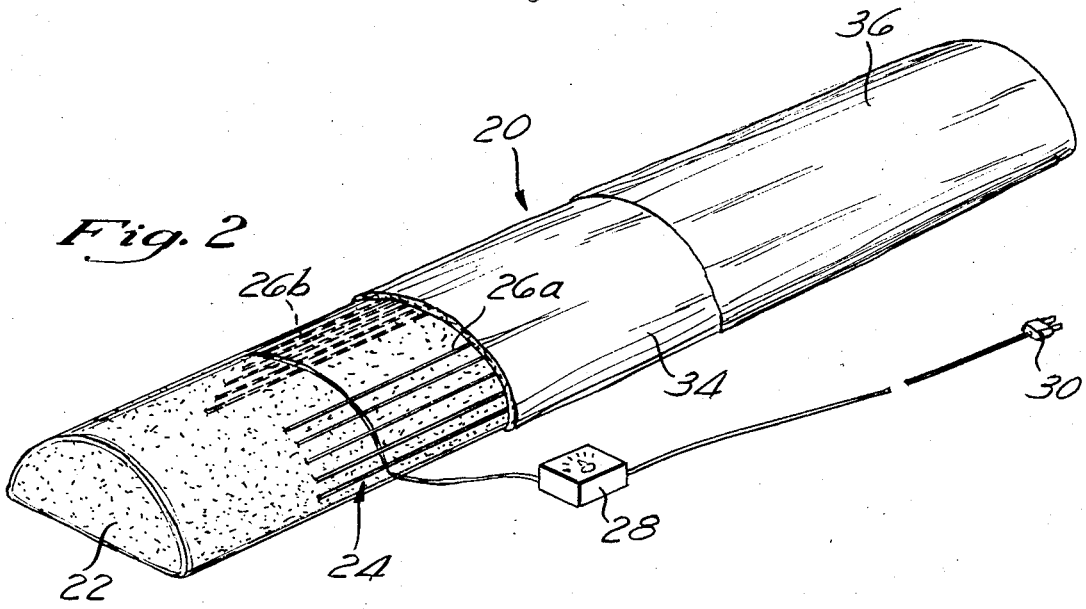
Fig. 4
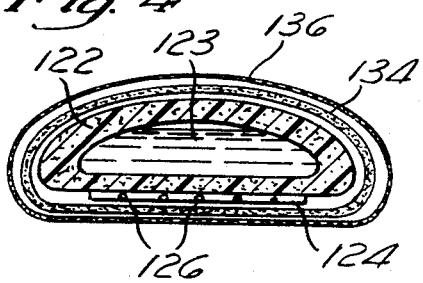
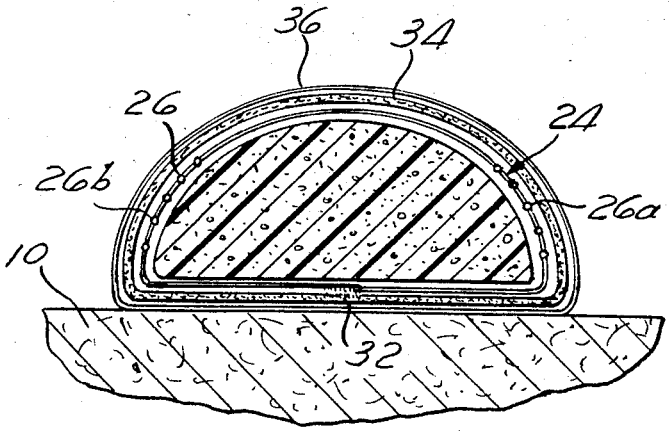
Fig. 3

COMPANION WARMER

Field of the Invention

This invention relates to sleeping appliances for keeping a human user warm during the sleeping hours.

BACKGROUND OF THE INVENTION

Mankind has been faced since the very beginning with the challenge of finding a way to keep warm while asleep. Since no natural heat is generated due to lack of exercise while asleep, it is necessary to provide additional means of warming or retaining heat while the individual sleeps. Traditionally, of course, this is done by providing a relatively thick or heavy heat insulating cover. The use of electric blankets is now extremely common and provides a source of heat which is generally satisfactory in assuring that an adequate supply of heat during sleeping is available. However, electric blankets suffer from many disadvantages. Among these disadvantages are that the blanket is relatively inefficient, producing substantially more heat than is used by the individual. The blanket is uncomfortable because of the weight and rigidity of the electrical resistance heating lines which extend throughout the blanket. In addition, the individual is forced to accept whatever heat and whatever temperature is generated by the blanket at a given setting. Since the blanket covers the individual, it is not possible to move toward or away from the blanket.

An ancient technique for providing auxilliary heat was to heat bricks, rocks or heavy metal objects, wrap them in blanketing and put them in the bed to warm the bed or to provide auxilliary heat. This is of limited use, but did provide the advantage that the individual could approach the heated object as closely as desired to provide the most comfortable temperature. Heating pads are also available which provide heat for very limited spots.

The present invention overcomes the disadvantages of the electric blanket and of the conventional systems by providing a highly efficient, conveniently configured, and comfortably dimensioned heater which is uniquely adapted to be placed in the bed underneath the insulative covering to provide a source of heat along the length of the user's body, to which the user may approach or retreat, and which can be controlled to temperature.

SUMMARY OF THE INVENTION

The invention comprises a combination of an elongate soft resilient foamed polymer body which is so constructed and configured as to lie, when in use, along side the body of a human user. The polymer body has a bottom, a top, and two sides, and is approximately the length of the body of the user, excluding the user's neck and head, and has a thickness from the bottom to the top of approximately the thickness, from front to back, of the user's body. The polymer body is so configured and constructed as to resiliently resist folding, though it may be bent, and to retain its normal elongate configuration. The polymer body is enclosed by a heater. The heater is formed of fabric and includes electrically insulated resistance heating lines secured to the fabric, or between two layers of fabric which act as one layer, and means for connecting the resistance heating line to a source of electric power, and for controlling the temperature of the resistance heating lines. Means are provided for securing the heater about the polymer body. The electrically insulated resistance heating lines extend substantially the length of the polymer body on at least one side, and preferably on both sides. While the heating lines may extend along the top or the bottom of the body, there is no advantage in doing so, and it is preferable to have the heating lines concentrated along the sides of the polymer body. The polymer body, in its most preferred embodiment, is semi-arcuate in cross-section, and has a thickness of from about four inches to about eight inches. Preferably, hook and loop type fasteners, secured to the respective edges of the heater fabric, are used to secure the heater about the polymer body. It is also preferred to provide one or more additional sleeves or cases which slip over the elongate, heater-covered, polymer body, to provide additional softness and protection from the inherent rigidity and localized heat of the resistance heating wires. The combination is light and readily moveable, and provides a source of heat, the temperature of which can be adjusted, which extends along the length of the user's body and provides the user with as much heat as desired, the user simply approaching toward or retreating from the immediate presence and contact with the heater of the invention.

In one aspect, the invention comprises the combination of a bed with conventional heat insulative coverings thereon, and including a heater-covered polymer body as just described within the space between the coverings and the mattress portion of the bed.

The invention finds particularly important application in rest homes and hospitals, and is easily configured to be useful by children.

The invention is also an efficient energy savings device.

DESCRIPTION OF THE DRAWINGS

FIG. 1 is a plan view, somewhat schematic, of the combination of a bed and the heater of the invention showing its relationship to the user thereof.

FIG. 2 is a side view and partial cutaway, showing the elements of which the combination of this invention is constructed.

FIG. 3 is an end view and cross-section showing the elements of the heater combination of this invention.

FIG. 4 is an end view and cross-section showing the elements of an alternative heater combination according to this invention.

DETAILED DESCRIPTION OF THE INVENTION

It will be understood that in describing the invention, in depicting the invention of the drawing, and in giving the following detailed description, merely the preferred embodiment of the invention is described, and other embodiments of different configurations and arrangements are contemplated as falling within the scope of the invention.

Referring first to FIG. 1, the invention comprises in one combination a bed, including a mattress generally depicted at (10), and conventional heat insulative coverings (12), and, if desired, a pillow (14) upon which the user rests his or her head. The bed is in combination with the heater assembly (20).

The heater assembly (20) is shown in greater detail in FIGS. 2 and 3, and encompasses an elongate, foamed polymer body (22). The polymer body (22) has a top and a bottom, and, preferably, the bottom is flat and the top and the sides are generally arcuate in configuration, the cross-section of the body, as best shown in FIG. 3 being generally semi-circular. The shape of the arc, however, is of no consequence, and need not be circular. The thickness of the polymer body from the bottom to the top is approximately the thickness of the user, preferably slightly less than the thickness of the user, and would generally be from about four inches to about eight inches in thickness, although criticality is not found in this particular dimension.

A heater (24), which includes a continuous resistance heater line (26), shown in FIG. 3 at (26*a*) and (26*b*), affixed thereto, is wrapped around and encloses the elongate polymer body (22). Means are provided for controlling the temperature, as shown generally at (28), which comprises merely the conventional thermostatically controlled rheostat for controlling the heat input to the heating lines (26), and a cord and plug (30) for connecting the heater to a source of electric power. In some embodiments, the heating element also serves to control the temperature. The covering encompasses and encloses the foamed polymer body and is held in place, in the preferred embodiment, by a pair of VELCRO brand or other brand of hook and loop fasteners, generally indicated at (32), the respective portions of this fastener being secured to the respective edges of the heater, which, as best shown in FIG. 2, will be elongate, of generally the same longitudinal dimension as the length of the foamed body.

In the preferred embodiment, a boot of relatively heavy fabric, e.g., blanketing or the like, encompasses the heater. The softens, the touch and feel of the electric resistance heater (26), which is inherently somewhat rigid, also diffuses the heat so that the user tends to feel only a general area of heat, rather than discrete heated wires. A cover (36) for the entire combination is also desired. This is simply a slipcover to keep the entire assembly clean and protected from abuse.

These outer coverings are obviously not required, but are convenient and preferred.

In use, the user simply plugs in the cord and adjusts the rheostat to provide a desired temperature. The heater-wrapped polymer body is used in combination with the bed and is disposed lengthwise of the bed, such that the user's body lies generally parallel to the length of the heater combination when the user is sleeping.

It has been found from experimentation that it is extremely important that heat be applied to the user substantially the length of the user's body, excluding the head and shoulders. Accordingly, the length of the polymer body and the heaters is so configured as to approximate the length of the user's body, less the user's head and neck area. Exact correspondence and length is obviously not critical, but it is desirable that the combination of this invention be generally approximately the length of the user, excluding the user's head and neck. Also, it has been found that the heat applied along the sides of the foamed polymer body is very efficiently used by the user, whereas any heating lines along the top or on the bottom of the heated body are somewhat surplusage, and the heat is wasted. Further, to put a heater on the bottom of the unit could present safety hazards, since there would be a tendency to overheat. Heater lines on the top would simply generate heat which would be radiated through the coverings and would essentially be wasted. The resistance heater lines (26), which are covered with an electrically resistant material, may extend on both sides, or simply on one side of the foamed polymer body.

The combination of this invention may be left in place, or, if desired, may be removed and thrown crossways of the bed and used as a bolster when the bed is made in the morning, and then returned to its combinational use position with the bed at night before the user retires.

An alternative embodiment of the invention is shown in FIG. 4, wherein, resting upon the bed (10), there is a modified form of the warmer shown in FIG. 3. In the embodiment of FIG. 4, the body is a plastic film or foamed polymer body (122) filled with water, or other fluid, having a high heat capacity, indicated at (123). The heater, in this embodiment, shown at (124) is simply a strip heater lying beneath the body of water, having heating elements (126). Temperature control, etc., are provided as described previously, the only difference, in respect to heating, is that the body of water is heated to a predetermined temperature, as selected by the user, and maintains this temperature throughout the length and height of the warming body.

The warming body, in this embodiment, is typically somewhat thinner than the body previously described, having a thickness of about two to three inches, and having sidewalls, typically curved or arcuate sidewalls, as illustrated. In this embodiment, the heat radiates along the sidewalls as well as the top, but, effectively, along the sidewalls principally.

It has been found that this combinational invention provides heat in a nearly idealized configuration. Spot heat, as may result from heated bricks or rocks of ancient days, or from the conventional electric heating pad of today, is most unsatisfactory for most users. Electric blankets are also quite unsatisfactory to many users. Most find it difficult to adjust the electric blanket to provide a constantly comfortable level of heat application. In addition, the electric blanket tends to have hot spots and cold spots, and this makes it difficult for the individual to find those areas of the blanket in which they are fully comfortable. Contrariwise, the present invention provides heat along the length of the user's body, but the user can move toward or away from the heat to find that zone which is optimum and of the maximum comfort to the particular user. This, of course, is not possible using the electric blanket. This invention provides a solution to a problem which is centuries old. As recorded in the Old Testament of the Bible, "Two are better than one . . . if two lie together, then they have heat; but how can one be warm alone?" (Ecclesiastes 4:9-11). Thus, while the problem has been long standing, there have been countless efforts to solve the problem. This invention provides the most comprehensive and yet the most simple solution to the problem as yet devised.

INDUSTRIAL APPLICATION

This invention finds application in the consumer market for providing warmth to human users during the sleeping hours, especially comfort and warmth for the single sleeper using the companion warmer.

What is claimed:

1. In combination, (a) an elongate soft resilient polymer body (22) so constructed and configured as to lie, when in use, along side a body of a human user, said polymer body having a bottom and a top and two sides, and being approximately the length of the body of the user, excluding the user's neck and head, having sidewalls, and having a thickness from bottom to top approximately equal to the thickness from front to back of a user's body, said polymer body being so configured and constructed as to resiliently resist folding and retain its normal elongate configuration; and (b) at least one heater so constructed as to warm sidewalls of said polymer body, means for connecting the heater to a source of electric power (30), means for controlling the temperature of the heater, and means for securing said heater adjacent said body (32).

2. The combination of claim 1, wherein the polymer body is semi-arcuate in cross-section, and has a thickness of from about four to about eight inches.

3. The combination of claim 1, comprising means for securing the heater about the polymer body which include a pair of mating hook and loop fasteners secured respectively to the heater, said fasteners being normally disposed when in use under the bottom of the polymer body.

4. The combination of claim 1, wherein the polymer body is semi-arcuate in cross-section, has a thickness of from about four to about eight inches, and contains a body of high heat capacity liquid.

5. The combination comprising (a) a sleeping bed (10) for a human user having a length and a width, (b) heat insulating coverings (12) for retaining warmth of the user during use, (c) an elongate soft resilient foamed polymer body (22) so constructed and configured as to lie, when in use, along side a body of a human user, said polymer body having a bottom and a top and two sides, and being approximately the length of the body of the user, excluding the user's neck and head, and having a thickness from bottom to top approximately equal to the thickness from front to back of a user's body, said polymer body being so configured and constructed as to resiliently resist folding and retain its normal elongate configuration; and (b) a heater (24) enclosing said polymer body, said heater being formed of fabric, electrically insulated resistance heating lines (26) secured to said fabric, means for connecting the resistance heating lines to a source of electric power (30), means for controlling the temperature of the electrical resistance heating lines (28), and means for securing said heater about said polymer body (32), the electrically insulated resistance heating lines extending substantially the length of the polymer body on at least one side thereof; the heater enclosed polymer body lying lengthwise of the sleeping bed under the heat insulating coverings.

6. The combination of claim 5, wherein the polymer body is semi-arcuate in cross-section, and has a thickness of from about four to about eight inches.

7. The combination of claim 5, wherein the means for securing the heater about the polymer body includes a pair of mating hook and loop fasteners secured respectively to two sides of the fabric, said fasteners being normally disposed when in use under the bottom of the polymer body.

8. The combination of claim 7, wherein the polymer body is semi-arcuate in cross-section, and has a thickness of from about four to about eight inches.

9. In combination, (a) an elongate soft resilient foamed polymer body (22) so constructed and configured as to lie, when in use, along side a body of a human user, said polymer body having a relatively flat bottom and a generally arcuate top and two sides, and being approximately the length of the body of the user, excluding the user's neck and head, and having a thickness from bottom to top of from approximately four to eight inches approximately equal to the thickness from front to back of a user's body, said polymer body being so configured and constructed as to resiliently resist folding and retain its normal elongate configuration; (b) a heater (24) enclosing said polymer body, said heater being formed of fabric, electrically insulated resistance heating lines (26) secured to said fabric, means for connecting the resistance heating lines to a source of electric power (30), means for controlling the temperature of the electrical resistance heating lines (28), and means for securing said heater about said polymer body (32), the electrically insulated resistance heating lines extending substantially the length of the polymer body on at least one side thereof; and, at least one heat insulating fabric cover enclosing the heater enclosed polymer body.

* * * * *